US005176206A

United States Patent [19]

Nagasaka et al.

[11] Patent Number: 5,176,206

[45] Date of Patent: Jan. 5, 1993

[54] LAMINATE TYPE HEAT EXCHANGER

[75] Inventors: Yoshikiyo Nagasaka; Ichiro Noguchi, both of Konan, Japan

[73] Assignee: Zexel Corporation, Tokyo, Japan

[21] Appl. No.: 696,687

[22] Filed: Apr. 23, 1991

[30] Foreign Application Priority Data

Jun. 5, 1990 [JP] Japan ..... 2-147117

[51] Int. Cl.[5] ..... F28D 1/03; F28F 3/00

[52] U.S. Cl. ..... 165/153; 165/166

[58] Field of Search ..... 165/152, 153, 166

[56] References Cited

U.S. PATENT DOCUMENTS

| | | | |
|---|---|---|---|
| 4,487,038 | 12/1984 | Iijima | 165/166 |
| 4,723,601 | 2/1988 | Ohara | 165/166 |
| 4,800,954 | 1/1989 | Noguchi et al. | 165/153 |
| 5,058,662 | 10/1991 | Nguyen | 165/153 |

FOREIGN PATENT DOCUMENTS

| | | | |
|---|---|---|---|
| 63-153397 | 6/1988 | Japan . | |
| 57095 | 3/1989 | Japan | 165/153 |

*Primary Examiner*—John Rivell
*Assistant Examiner*—L. R. Leo
*Attorney, Agent, or Firm*—Frishauf, Holtz, Goodman & Woodward

[57] ABSTRACT

A laminate type heat exchanger includes a plurality of tubular elements each formed of a pair of generally flat stamped plates joined together in an abutting manner, a plurality of fins, the tubular elements and the fins being superposed one upon another in an alternate manner to form a laminate structure and a pair of end plates attached to outermost ones of the tubular elements at opposite ends of the laminate structure. The end plates each have a joining section joined to an associated one of the outermost tubular elements, and a swelled main portion. The joining section of each end plate includes a joining portion abutting against a portion of one side surface of an associated outermost stamped plate, which portion corresponds in location to a portion of a recess formed in the other side surface of the associated outermost stamped plate. The joining portion is shaped and sized such that at least one row of depressions formed in the one side surface of the associated outermost stamped plate communicates with one of the interior of the swelled main portion of the end plate and the outside of the heat exchanger.

3 Claims, 4 Drawing Sheets

LAMINATE TYPE HEAT EXCHANGER

BACKGROUND OF THE INVENTION

This invention relates to a laminate type heat exchanger, and more particularly to a laminate type heat exchanger for use as an evaporator of an automotive air conditioning system or the like.

A conventional laminate type heat exchanger of this type comprises a plurality of tubular elements each formed of a pair of generally flat stamped plates joined together in an abutting manner along angled outer peripheral edges thereof, the tubular elements each having tanks at one end thereof, a plurality of fins, typically corrugated, the tubular elements and the fins being superposed one upon another in an alternate manner to form a laminate structure, and a pair of end plates attached to outermost ones of the tubular elements at opposite ends of the laminate structure, as disclosed in Japanese Provisional Patent Publication (Kokai) No. 63-153397.

This laminate type heat exchanger has a tank section at one end thereof, and each end plate and its associated stamped plate are joined together at one end of the tubular element remote from the tank section in a manner as shown in FIG. 1. As shown in the figure, the outermost stamped plate 100 has an inner side surface thereof formed with a generally flat refrigerant passage-forming recess 102 bordered by its angled outer peripheral edge 101. A multiplicity of projections or beads 103 are formed integrally over the surface of the refrigerant passage-forming recess 102. The end plate 110 which is attached to each outermost stamped plate 100 is so shaped or stamped as to have a joining peripheral portion (joining portion) 111 abutting against an outer side surface 102*a* of the stamped plate 100 at a location corresponding to at least two recessed portions of the recess 102, and a swelled main portion 112 defining therein a space accommodating a corrugated fin 120 together with the outer side surface 102*a* of the stamped plate 100. The joining portion 111 of the end plate 110 is brazed to the outer side surface 102*a* of the stamped plate 100.

However, in the conventional heat exchanger, the joining portion 111 of the end plate 110 abuts against and brazed to the outer side surface 102*a* of the stamped plate 100 at a location corresponding to at least two recessed portions of the recess 102, as noted above. As a result, an enclosed space 130 is defined in the joined portions of the end plate 110 and the stamped plate 100. In addition, the joining portion 111 of the end plate 110 and the outer side surface 102*a* of the stamped plate 100 are joined together in a face-to-face manner by brazing so that usually gaps such as pinholes can be formed in the brazed surfaces.

As a consequence, when a refrigerant flows in a refrigerant passage formed between the recess 102 of the paired stamped plates 100 to cool ambient air surrounding the enclosed space 130, the resulting condensed moisture in the ambient air enters the enclosed space 130 through the gaps such as pinholes. As the temperature of the enclosed space 5 further lowers, the condensed moisture becomes frozen to be swelled, which can cause exfoliation of the brazed surfaces in the vicinity of the enclosed space 130.

SUMMARY OF THE INVENTION

It is therefore the object of the invention to provide a laminate type heat exchanger which is free from exfoliation of the brazed surfaces due to swelling of the condensed moisture when it is frozen.

To attain the above object, the present invention provides a laminate type heat exchanger including a plurality of tubular elements each formed of a pair of generally flat stamped plates joined together in an abutting manner, the tubular elements each having a tank section at one end thereof, a plurality of fins, the tubular elements and the fins being superposed one upon another in an alternate manner to form a laminate structure, and a pair of end plates attached to outermost ones of the tubular elements at opposite ends of the laminate structure, the end plates each having a joining section joined to an associated one of the outermost ones of the tubular elements, a swelled main portion, and a fin accommodated within the swelled main portion, the stamped plates each having one side surface thereof formed with a recess forming a thermal medium passage in cooperation with a recess formed in one side surface of an associated one of the stamped plates, the recess having a surface thereof formed with a multiplicity of projections arranged in a plurality of rows, outermost ones of the stamped plates at the opposite ends of the laminate structure each having one end thereof remote from the tank section provided with a portion of the recess adjacent at least one row of the projections, and at least one row of depressions formed in another side surface thereof at a location corresponding to the at least one row of the projections.

The laminate type heat exchanger according to the invention is characterized in that the joining section of each of the end plates includes a joining portion abutting against a portion of the another side surface of an associated one of the outermost ones of the stamped plates, said portion of the another side surface corresponding in location to the aforesaid portion of the recess, the joining portion being shaped and sized such that the at least one row of the depressions of the associated one of the outermost ones of the stamped plates communicates with one of the interior of the swelled main portion of the each of the end plates and the outside of the heat exchanger.

The above and other objects, features, and advantages of the invention will be more apparent from the ensuing detailed description taken in conjunction with the accompanying drawings.

DETAILED DESCRIPTION

The invention will now be described in detail with reference to embodiments thereof. In the embodiments described hereinbelow, the laminate heat exchangers according to the invention are embodied as evaporators for use in automotive air conditioning systems.

Figure 2:
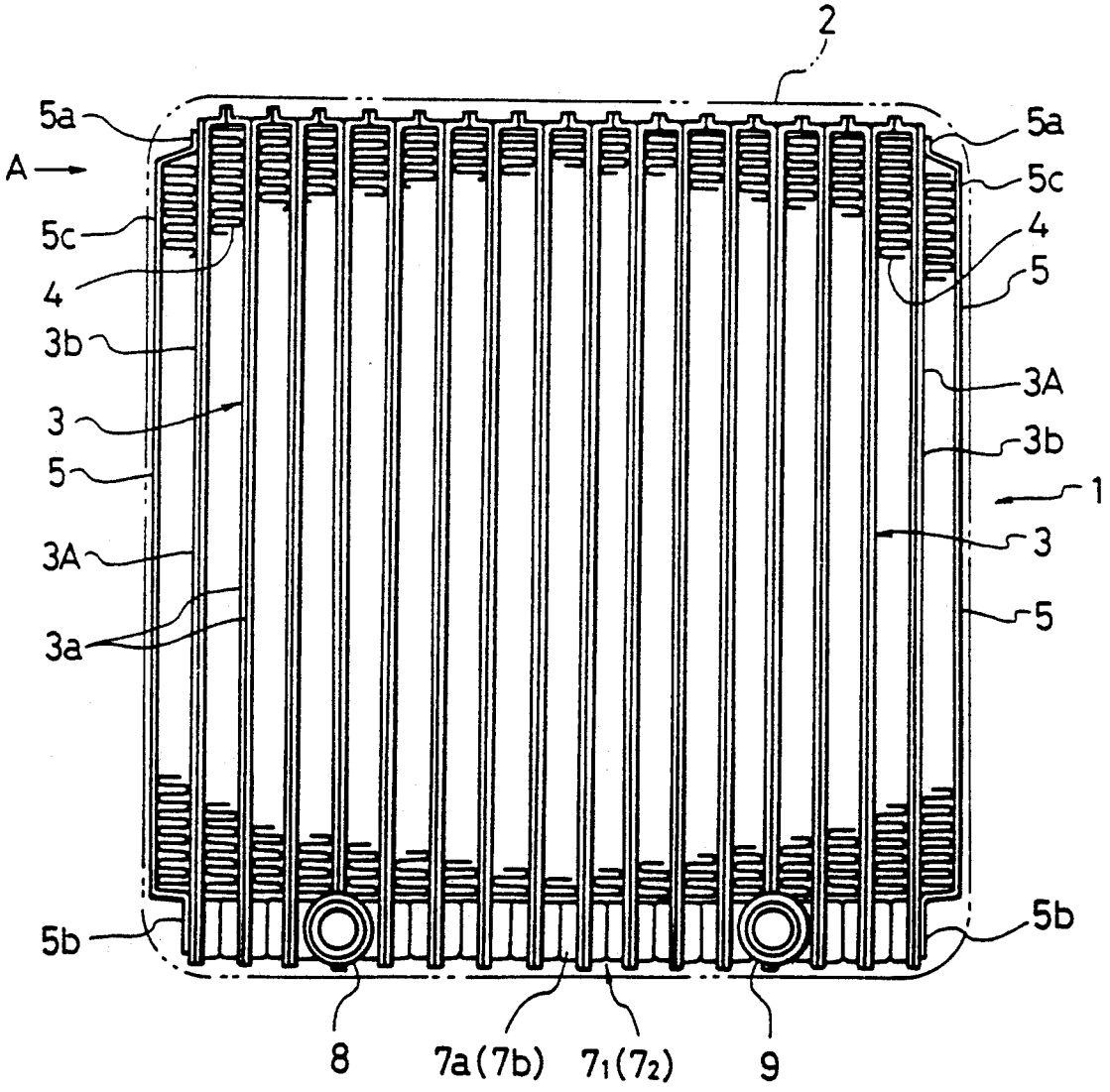
FIG. 2 is a front view of a laminate type heat exchanger according to a first embodiment of the invention.

Referring first to FIG. 2, there is illustrated a laminate type heat exchanger according to a first embodiment of the invention. In the figure, reference numeral 1 designates the heat exchanger having a casing 2.

The heat exchanger 1 comprises a plurality of tubular elements 3, and a plurality of corrugated fins 4, the tubular elements 3 and the fins 4 being superposed one upon another in an alternate manner to form a laminate structure, and a pair of end plates 5, 5 attached to outermost ones 3A, 3A of the tubular elements at opposite ends of the laminate structure. The illustrated heat exchanger 1 comprises 16 pairs of tubular elements and corrugated fins.

Each tubular element 3 comprises a pair of generally flat stamped plates 3*a*, 3*a* joined together in an abutting manner. The joined stamped plates 3*a*, 3*a* cooperatively define a refrigerant passage, not shown, therebetween, a first tank 7*a* arranged on an upstream side in the direction of flow of heat-exchanging air flowing through the refrigerant passage, and a second tank 7*b* arranged on a downstream side in the same direction. The refrigerant passage has a U-shaped configuration divided by partitions formed on the stamped plates by partition-forming projections having the same configuration as a partition-forming projection 24 formed on an outermost stamped plate 3*b* at an end of the heat exchanger, appearing in FIG. 3, hereinafter referred to, such that refrigerant can flow from the first tank 7*a* to the second tank 7*b* or vice versa. A first tank section $7_1$ is formed by the first tanks 7*a* of the stamped plates 100, while a second tank section $7_2$ is formed by the second tanks of the stamped plates 100. The first and second tank sections $7_1$, $7_2$ will be hereinafter generically called a tank section 7. First tanks 7*a* forming the first tank section $7_1$ other than those at a central portion of the laminate structure are communicated with each other by means of communication holes, not shown, while all the second tanks 7*b* forming the second tank section $7_2$ are communicated with each other by means of communication holes, not shown, over the whole length of the laminate structure.

A refrigerant-inlet pipe 8 is connected to the laminate structure at a left side with respect to a central portion of the inlet side tank section $7_1$, while a refrigerant-outlet pipe 9 is connected to the laminate structure at a right side with respect to a central portion of the outlet side tank section $7_2$.

Each end plate 5 is so shaped or stamped as to have a joining portion 5*a* at an end thereof remote from the tank section 7, a joining portion 5*b* at the other end provided with the tank section 7, and a swelled main portion 5*c* accommodating a corrugated fin 4, the joining portions 5*a*, 5*b* being brazed to the respective associated stamped plates at the opposite ends of the laminate structure. The manner of brazing the joining portion 5*a* at the end remote from the tank section 7 to its associated outermost tubular element 3 will be hereinafter described in detail.

In the laminate type heat exchanger constructed as above, refrigerant flows through the refrigerant-inlet pipe 8 into the left-hand half of the first tank section $7_1$, wherefrom it further flows through the refrigerant passages defined within the tubular elements 3 on the left-hand side into the left-hand half of the second tank section $7_2$. Since all the tanks 7*b* of the second tank section $7_2$ are communicated with each other over the whole length of the laminate structure as mentioned above, the refrigerant flowing into the left-hand half of the second tank section $7_2$ then flows into the right-hand half of the second tank section $7_2$, wherefrom it further flows through the refrigerant passages defined within the tubular elements 3 on the right-hand side into the right-hand half of the first tank section $7_1$, to be drained through the refrigerant-outlet pipe 9.

Figure 3:
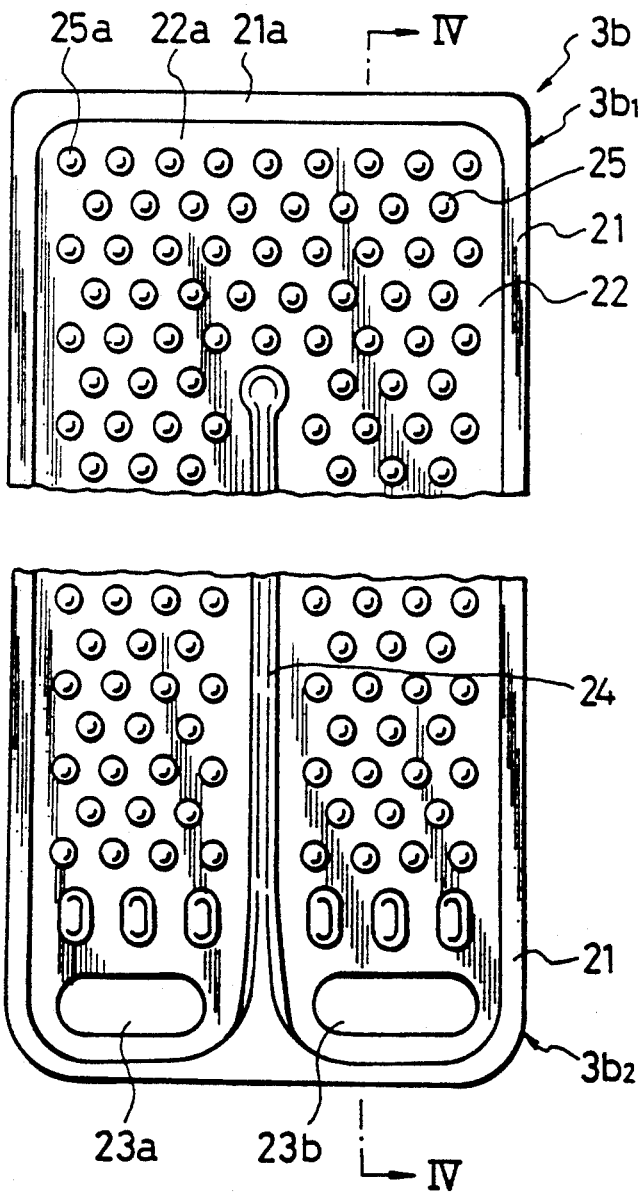
FIG. 3 is a front view of an outermost stamped plate at an end of the heat exchanger.
Figure 4:
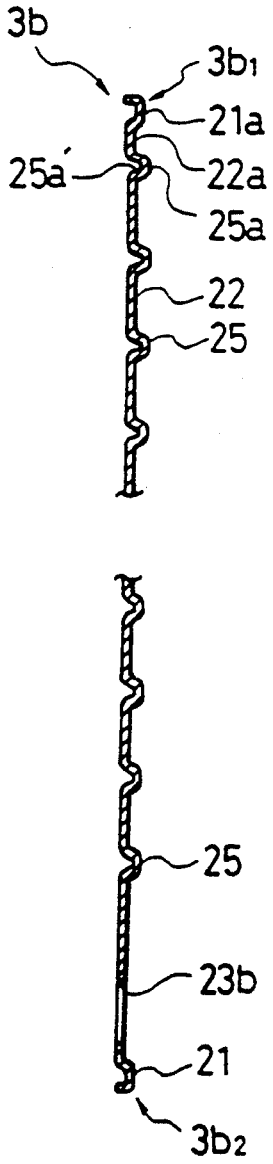
FIG. 4 is a sectional view taken along line IV—IV in FIG. 3.

The outermost stamped plates 3*b* at the opposite ends of the laminate structure are each in the form of a generally rectangular plate as shown in FIGS. 3 and 4, having its whole outer peripheral edge angled or bent toward the associated end plate 5 as an angled peripheral edge 21, and its inner side surface formed with a generally flat recess 22 bordered by the angled peripheral edge 21 and defining a refrigerant passage, not shown, in cooperation with a recess 22 formed in the counterpart stamped plate 3*b*. Each outermost stamped plate 3*b* has its lower end formed with a through hole 23*a* forming an end of the first tank section $7_1$, and a through hole 23*b* forming an end of the second tank section $7_2$. A partition-forming elongate projection 24 is formed integrally on the inner side surface of the stamped plate 3*b*, which vertically extends from a location between the through holes 23*a*, 23*b* and terminates at an intermediate point on the inner side surface. Projections, not shown, formed on the joining portion 5*b* on the tank section side end of each end plate 5 are fitted into respective ones of the through holes 23*a*, 23*b* to close the opposite ends of the first and second tank sections $7_1$, $7_2$.

The refrigerant passage-forming recess 22 of each outermost stamped plate 3*b* is formed integrally with a multiplicity of projections or beads 25 over almost the entire surface thereof from an end $3b_1$ remote from the tank section to the other end $3b_2$ close to the tank section, the projections 25 being arranged in rows and in spaced relation to each other.

Figure 5:
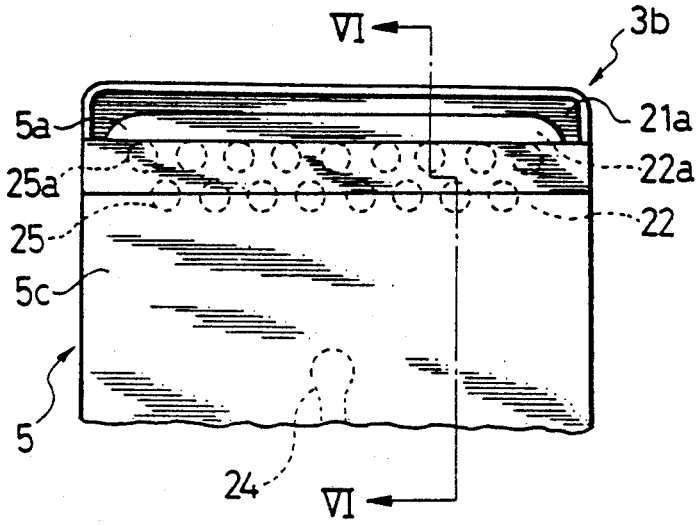
FIG. 5 is a fragmentary view of joined portions of the end plate and the stamped plate at ends thereof remote from the tank section, as viewed from a side indicated by the arrow A in FIG. 2.
Figure 6:
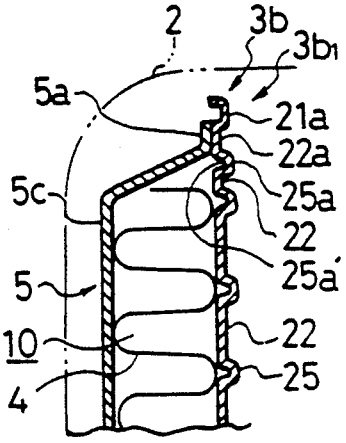
FIG. 6 is a fragmentary sectional view taken along line VI—VI in FIG. 5.

On the other hand, as shown in FIGS. 5 and 6, each end plate 5 is configurated and sized such that the joining portion 5*a* at the end remote from the tank section abuts against the outer side surface of the outermost stamped plate 3*b* at a location corresponding to a portion 22*a* of the refrigerant passage-forming recess 22 between an angled peripheral edge portion 21*a* at the end 3*b* remote from the tank portion and projections 25*a* in the row closest to the angled peripheral edge portion 21*a*. The joining portion 5*a* is brazed to the outer side surface of the stamped plate 3*b*.

Thus, according to the present embodiment, the joining portion 5*a* of each end plate 5 is joined to the outer side surface of the stamped plate 3*b* only at the location corresponding to the recess portion 22*a*, but not at a location corresponding to the projections 25*a* in the row closest to the angled peripheral edge portion 21*a* of the end plate 5 so that it does not cover depressions 25*a'* formed in the outer side surface of the stamped plate 3*b* at a location corresponding to the projections 25*a* in the closest row. Therefore, no enclosed space is formed between joined portions of the end plate 5 and the stamped plate 3*b*. As a result, even in the case where condensed moisture enters gaps in the form of pinholes formed between the brazed surfaces of the joining portion 5*a* and the outer side surface portion of the stamped plate 3*b*, the condensed moisture drops into a heat exchanging air passage 10 defined between the swelled main portion 5*c* of the end plate 5 and the outer side surface of the stamped plate 3, wherefrom it falls into the end of the tank section to be drained to the outside. Thus, no exfoliation of the brazed surfaces can occur due to swelled frozen moisture.

Further, by virtue of the angled peripheral edge portion 21*a* immediately adjacent the brazing surface portion of the stamped plate 3*b* corresponding in location to the refrigerant passage-forming recess portion 22*a* remote from the tank section, the brazing surface portion has high strength and high surface flatness, thereby enabling positive brazing without the possibility of poor brazing.

Next, a second embodiment of the invention will be described with reference to FIGS. 7 and 8.

Figure 7:
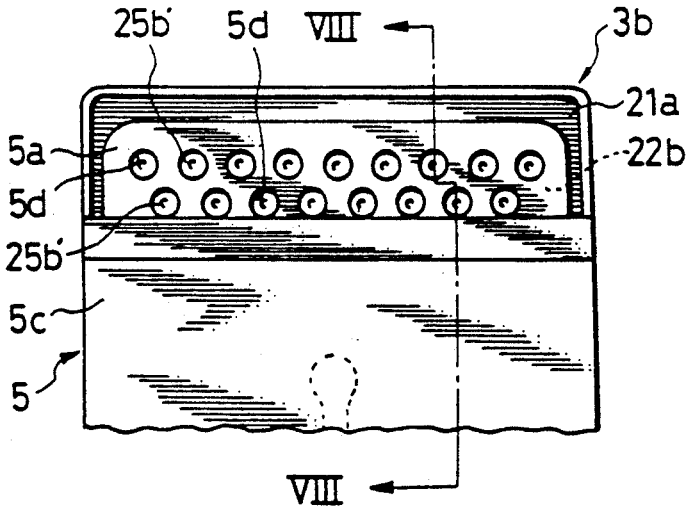
FIG. 7 is a fragmentary side view similar to FIG. 5, showing a second embodiment of the invention.
Figure 8:
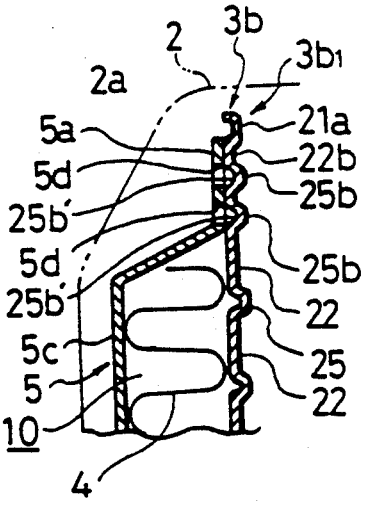
FIG. 8 is a sectional view taken along line VIII—VIII in FIG. 7.

In the second embodiment, as shown in FIGS. 7 and 8, each end plate 5 is configurated such that its joining portion 5*a* at the end remote from the tank section abuts against and brazed to an outer side surface portion of the stamped plate 3*b* corresponding in location to a refrigerant passage-forming recess portion 22*b* close to the angled peripheral edge portion 21*a* in a manner covering depressions 25*b'* formed in the outer side surface at a location corresponding to projections 25*b* in at least one row close to the end of the stamped plate 3*b* remote from the tank section. The joining portion 5*a* has through holes 5*d* formed therein at locations corresponding to respective depressions 25*b'* such that the former face the latter.

According to this embodiment, no enclosed space is formed in the joined portions of the end plate 5 and the stamped plate 3*b* so that even when condensed moisture enters the depressions 25*b'* through pinhole-like gaps formed in the brazed surfaces, the condensed moisture drains to the outside through the through holes 5*d* formed in the joining portion 5*a*, whereby no exfoliation of the brazed surfaces can occur due to the swelled frozen moisture.

Further, according to the second embodiment, the joining portion 5*a* can be designed to have a larger vertical size than that in the first embodiment so that the swelled main portion 5*c* can be located at a lower level than that in the first embodiment, which enables to shape a corner portion 2*a* of the heat exchanger casing 2 so as to conform to the shape of the corresponding corner portion of the body of the heat exchanger 1, i.e. have a longer tapered surface, and hence make the casing 2 more compact in size.

Figure 9:
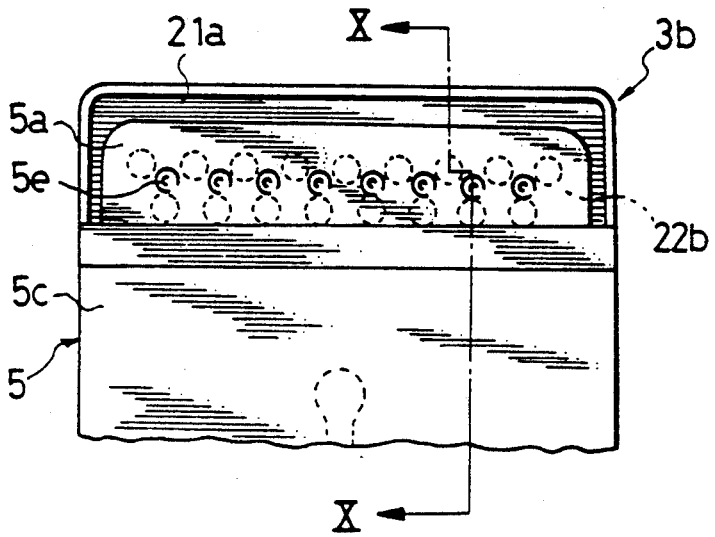
FIG. 9 is a fragmentary side view similar to FIG. 5, showing a third embodiment of the invention.
Figure 10:
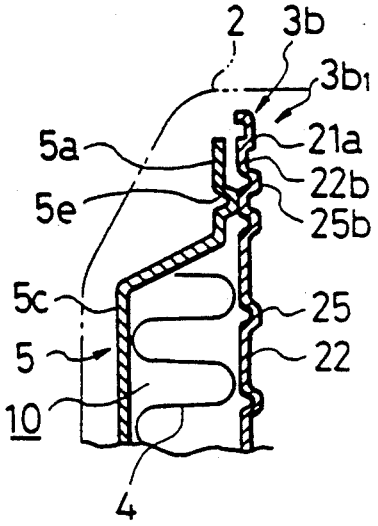
FIG. 10 is a sectional view taken along line X—X in FIG. 9.
Figure 1:
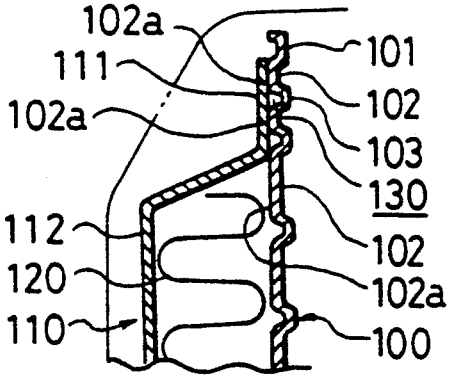
FIG.1 PRIOR ART
FIG. 1 is a fragmentary sectional view of joined portions of an end plate and its associated stamped plate at one end of a conventional laminate type heat exchanger remote from a tank section thereof.

FIGS. 9 and 10 show a third embodiment of the invention.

In the third embodiment, as shown in FIGS. 9 and 10, the joining portion 5*a* of each end plate 5 is in the form of a plurality of projections 5*e* arranged in at least one row, which abut against the outer side surface of the stamped plate 3*b* at a location corresponding to the refrigerant passage-forming recess portion 22*b* and brazed thereto.

As a result, portions of the joining portion 5*a* of the end plate 5 other than the joining projections 5*e* are kept out of contact with, i.e. spaced from the outer side surface portion of the stamped plate 3*b* corresponding in location to the refrigerant passage-forming recess portion 22*b*. Therefore, no enclosed space is formed in the joined portions of the end plate 5 and the stamped plate 3*b* so that even when condensed moisture enters a gap between the joining portion 5*a* and the outer side surface of the stamped plate 3*b*. the condensed moisture drops to the tank section through the heat exchanging air passage 10 to be drained to the outside, whereby no exfoliation of the brazed surfaces can occur due to swelled frozen moisture.

Further, the third embodiment has the advantage that the brazing can be efficiently and positively effected like fillet welding.

What is claimed is:

1. In a laminate type heat exchanger including a plurality of tubular elements each formed of a pair of generally flat stamped plates joined together in an abutting manner, said tubular elements each having a tank section at one end thereof, a plurality of fins, said tubular elements and said fins being superposed one upon another in an alternate manner to form a laminate structure, and a pair of end plates attached to outermost ones of said tubular elements at opposite ends of said laminate structure, said end plates each having a joining section joined to an associated one of said outermost ones of said tubular elements, a swelled main portion, and a fin accommodated within said swelled main portion, said stamped plates each having one side surface thereof formed with a recess forming a thermal medium passage in cooperation with an associated recess formed in one side surface of an associated one of said stamped plates, said recess having a surface thereof formed with a multiplicity of projections arranged in a plurality of rows, outermost ones of said stamped plates at said opposite ends of said laminate structure each having one end thereof remote from said tank section provided with a portion of said recess adjacent at least one row of said projections, and at least one row of depressions formed in another side surface thereof at a location corresponding to said at least one row of said projections, the improvement wherein said joining section of each of said end plates includes a joining portion abutting against a portion of said another side surface of an associated one of said outermost ones of said stamped plates, said portion of said another side surface corresponding in location to said portion of said recess, said joining portion not covering any row of said depressions of said associated one of said outermost ones of said stamped plates, all rows of said depressions communicating with the interior of said swelled main portion of said each of said end plates.

2. In a laminate type heat exchanger including a plurality of tubular elements each formed of a pair of generally flat stamped plates joined together in an abutting manner, said tubular elements each having a tank section at one end thereof, a plurality of fins, said tubular elements and said fins being superposed one upon another in an alternate manner to form a laminate structure, and a pair of end plates attached to outermost ones of said tubular elements at opposite ends of said laminate structure, said end plates each having a joining section joined to an associated one of said outermost ones of said tubular elements, a swelled main portion, and a fin accommodated within said swelled main portion, said stamped plates each having one side surface thereof formed with a recess forming a thermal medium passage in cooperation with an associated recess formed in one side surface of an associated one of stamped plates, said recess having a surface thereof formed with a multiplicity of projections arranged in a plurality of rows, outermost ones of said stamped plates at said opposite ends of said laminate structure each having an outer peripheral edge at one end thereof remote from said tank section, a portion of said recess located between said outer peripheral edge and one row of said projections closest to said outer peripheral edge, the improvement wherein said joining section of each of said end plates includes a joining portion abutting against only a portion of said another side surface of an associated one of said outermost ones of said stamped plates, said portion of said another side surface corresponding in location to said portion of said recess located between said outer peripheral edge and one row of said projections closest to said outer peripheral edge.

3. A laminate type heat exchanger as claimed in claim 2, wherein at least said outer peripheral edge of each of said outermost ones of said stamped plates at said opposite ends of said laminate structure is an angled peripheral edge.

* * * * *